US006217160B1

(12) United States Patent
Reiten et al.

(10) Patent No.: US 6,217,160 B1
(45) **Date of Patent: *Apr. 17, 2001**

(54) INK JET NOZZLE HEAD

(75) Inventors: Hans Reiten, Velden; Peter Joseph Hollands, Baarlo, both of (NL)

(73) Assignee: Oce-Technologies B.V., Venlo (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/896,059

(22) Filed: Jul. 17, 1997

(30) Foreign Application Priority Data

Jul. 18, 1996 (EP) ..... 96202042

(51) Int. Cl.[7] ..... B41J 2/045
(52) U.S. Cl. ..... 347/71
(58) Field of Search ..... 347/68–72, 10, 347/11, 94; 310/348, 368

(56) References Cited

U.S. PATENT DOCUMENTS

| | | | | |
|---|---|---|---|---|
| 4,520,374 | * | 5/1985 | Koto | 347/71 |
| 4,843,493 | | 6/1989 | Nilsson . | |
| 5,270,740 | | 12/1993 | Naruse et al. . | |
| 5,761,783 | * | 6/1998 | Osawa et al. | 347/70 |
| 5,860,202 | * | 1/1999 | Okawa et al. | 29/25.35 |

FOREIGN PATENT DOCUMENTS

| | | |
|---|---|---|
| 3630206A1 | 3/1987 | (DE) . |
| 19511408A1 | 10/1995 | (DE) . |
| 0402172A1 | 12/1990 | (EP) . |
| 0420172B1 | 12/1990 | (EP) . |
| 95 26271 | 10/1995 | (WO) . |

OTHER PUBLICATIONS

Minoru, et al, English–language abstract of Japanese patent JP–A–3–293143.

* cited by examiner

*Primary Examiner*—John Barlow
*Assistant Examiner*—C. Dickens
(74) *Attorney, Agent, or Firm*—Birch, Stewart, Kolasch & Birch, LLP

(57) ABSTRACT

An ink jet nozzle head including a channel plate defining a linear array of equidistanced nozzles and a plurality of substantially parallel ink channels communicating with an associated nozzle, a vibration plate disposed on the channel plate, at least one block member containing a comb-like array of fingers which extend toward and engage the vibration plate, some fingers functioning as actuators for exerting mechanical pressure on ink contained in the ink channels which, in turn, expels ink droplets from the nozzles, at least one actuator being provided for each nozzle, and other fingers serving as support members for supporting the actuators at the vibration plate, where the reaction forces of the actuators are received, and a backing member disposed on the block member, wherein the pitch "a" of the support members is larger than the pitch "b" of the nozzles and the fingers are evenly distributed over the length of the nozzle array.

14 Claims, 3 Drawing Sheets

INK JET NOZZLE HEAD

BACKGROUND AND SUMMARY OF THE INVENTION

The present invention relates to a nozzle head for use in an ink jet printer. A nozzle head having the features specified hereinbelow is disclosed in EP-A-0 402 172. This nozzle head comprises a channel plate defining a linear array of equidistant nozzles and a plurality of parallel ink channels, each connected to a respective one of the nozzles. On one side of the channel plate there is disposed an array of elongate fingers projecting towards the nozzle plate and extending in parallel with the ink channels. The ends of these fingers facing away from the channel plate are interconnected by a plate-like backing member which is formed integrally with the fingers. The fingers and the backing plate are made of a piezoelectric ceramic material. Every second finger is provided with electrodes and serves as an actuator which, when a print signal is applied to the electrodes, compresses the ink liquid contained in the associated ink channel, so that an ink droplet is expelled from the nozzle. The other fingers intervening between the actuators serve as support members which are rigidly connected to the channel plate so that they can absorb the reaction forces generated by the actuators.

Since a support member is provided between each pair of consecutive actuators, each actuator is substantially shielded against the reaction forces from its neighbors, so that undesired cross-talk between the various channels is reduced.

In this conventional nozzle head, the pitch of the support members, i.e. the distances at which the support members are disposed in the direction of the linear nozzle array, is equal to the pitch of the nozzles. As a consequence, the total number of fingers per unit length in the direction of the linear nozzle array, i.e. the density with which the fingers have to be arranged, is twice the density of the nozzles. Since intricate manufacturing problems are involved in preparing a high-density array of fingers, it becomes difficult to reduce the pitch of the nozzles in order to improve the resolution of the printer.

It is accordingly an object of the present invention to provide a nozzle head for high-resolution printing which can easily be manufactured and nevertheless suppress cross-talk between the individual channels.

According to the present invention, the pitch of the support members is larger than that of the nozzles, so that there is no longer a one-to-one relationship between the support members on the one hand and the actuators, the ink channels and the nozzles on the other hand. The mean density of the fingers will accordingly be smaller than twice the density of the nozzles. Of course, the support members have to be arranged such that they are connected to the dam portions of the channel plate separating the individual ink channels, whereas the actuators have to be disposed adjacent to the ink channels and must not overlap with the dam portions. However, since the support members may be slightly offset from the centers of the dam portions and/or the actuators may be slightly offset from the centers of the ink channels, it is possible to distribute the fingers in such a manner that their spacings are comparatively large, so that even for a nozzle array with a reduced pitch, the array of fingers can be manufactured with conventional techniques, e.g. by cutting grooves into a block of piezoelectric material.

In a preferred embodiment, the ratio between the densities of the fingers and nozzles is 3:2, and every third finger is a support member. This embodiment has the advantage that each actuator has as its neighbors a support member on the one side and another actuator on the other side, so that for any pair of ink channels, the configurations of actuators and support members in the vicinity of these ink channels are either identical or mirror-symmetric. As a result, the configurations of actuators and support members will not lead to any differences in the generation of droplets.

The fingers may be arranged equidistantly, which has the advantage that the manufacturing process can be very simple and efficient.

BRIEF DESCRIPTION OF THE DRAWINGS

Preferred embodiments of the present invention will now be described in conjunction with the accompanying drawings, in which.

DETAILED DESCRIPTION OF THE INVENTION

Figure 1:
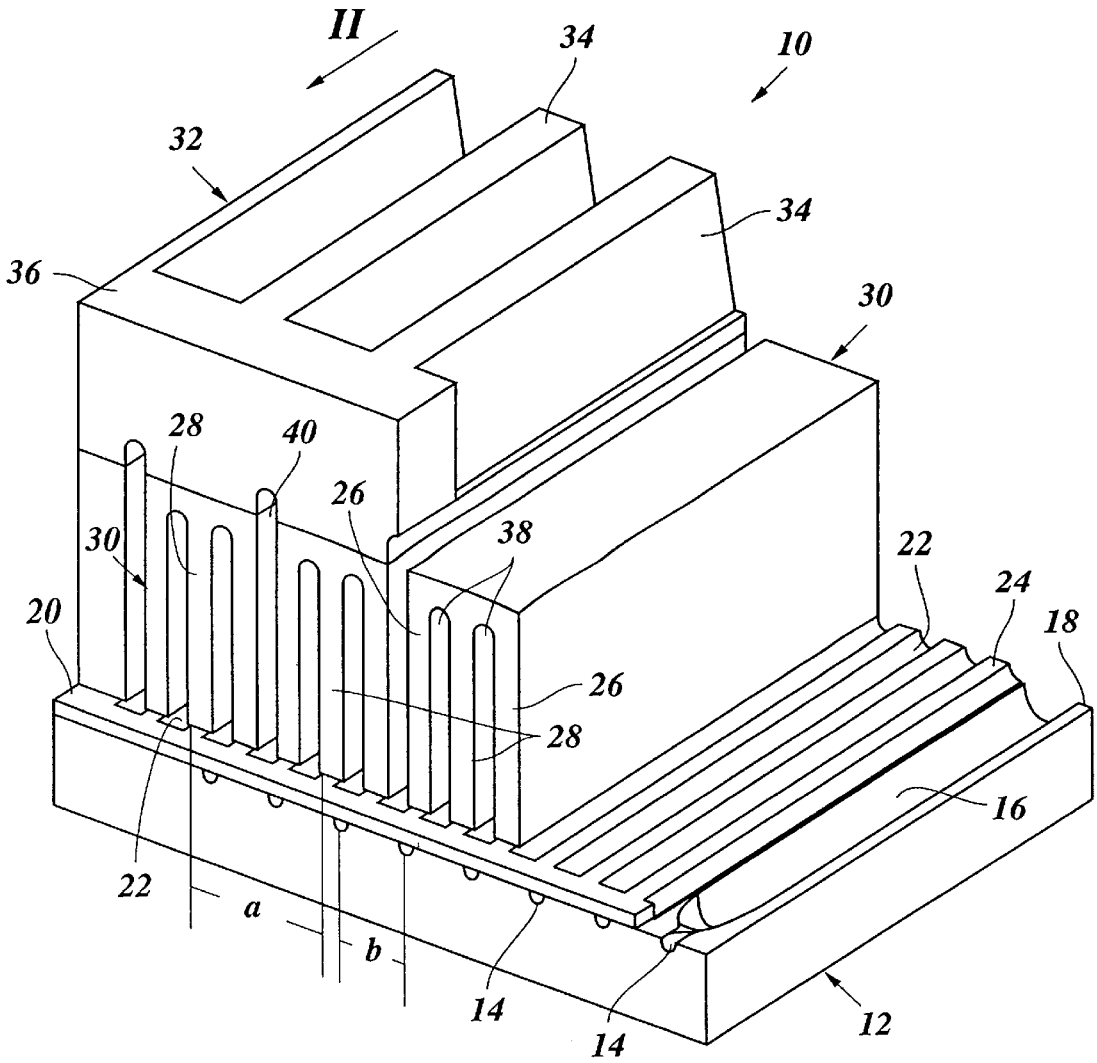
FIG. 1 is a partly broken-away perspective view of a nozzle head according to a first embodiment of the present invention.
Figure 2:
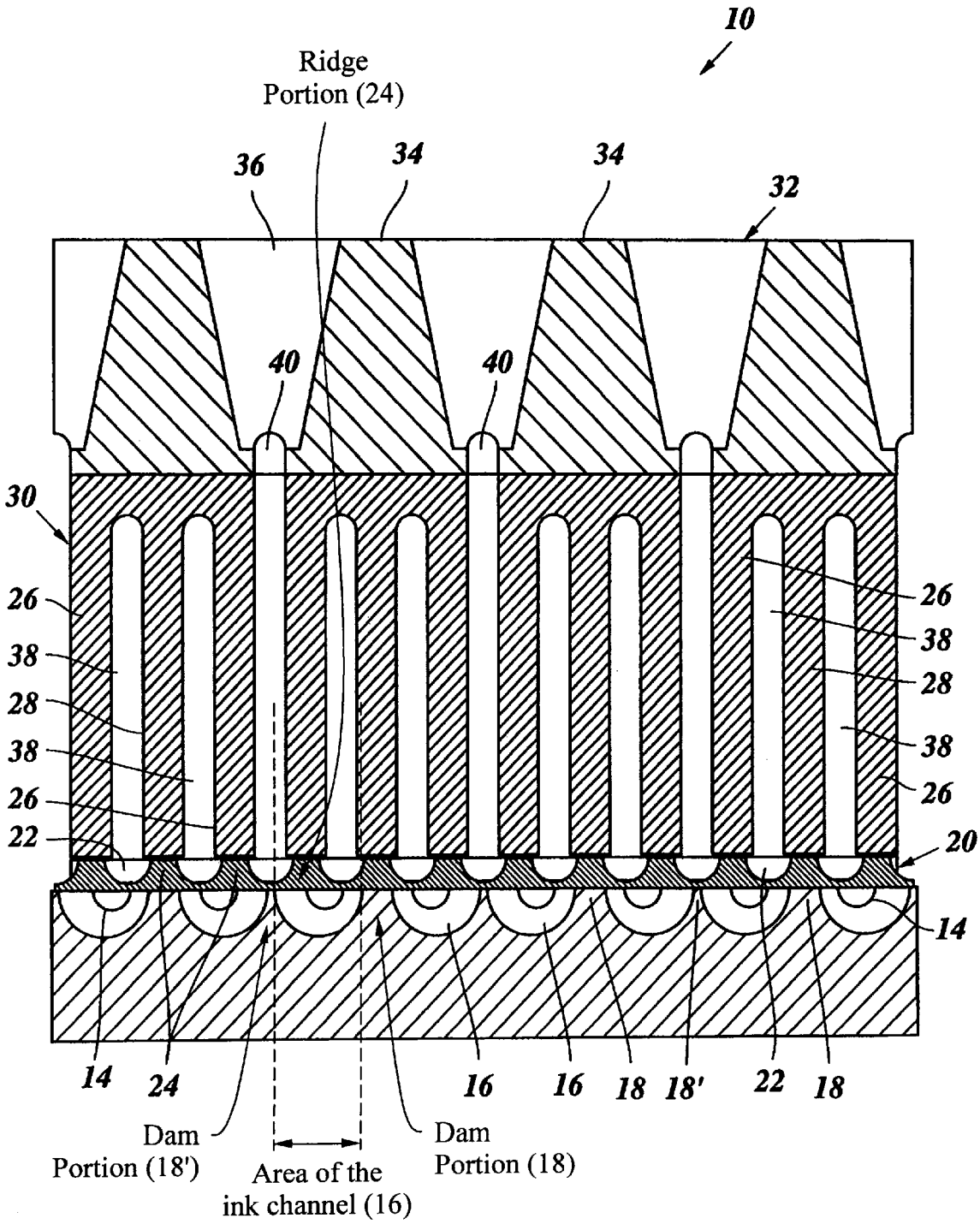
FIG. 2 is a cross-sectional view in the direction of the arrow II in FIG. 1.

The nozzle head 10 illustrated in FIGS. 1 and 2 comprises a channel plate 12 which defines a linear array of nozzles 14 and a number of parallel ink channels 16, only one of which is shown in FIG. 1. The nozzles 14 and the ink channels 16 are formed by grooves cut into the top surface of the channel plate 12. Each nozzle 14 is connected to an associated ink channel 16. The ink channels are separated by dam portions 18, 18'.

The top sides of the nozzles 14 and the ink channels 16 are closed by a thin vibration plate 20, which is securely bonded to the dam portions of the channel plate.

The top surface of the vibration plate 20 is formed with a series of grooves 22 which extend in parallel with the ink channels 16 and are separated by ridges 24. The ends of the grooves 22 adjacent to the nozzles 14 are slightly offset from the edge of the vibration plate 20.

An array of elongate fingers 26, 28 is disposed on the top surface of the vibration plate 20 such that each finger extends in parallel with the ink channels 16 and has its lower end fixedly bonded to one of the ridges 24. The fingers are grouped in triplets, each triplet consisting of a central finger 28 and two lateral fingers 26. The fingers of each triplet are interconnected at their top ends and are formed by a one-piece block 30 of piezoelectric material.

Each of the fingers 26 is associated with one of the ink channels 16 and is provided with electrodes (not shown) to which an electric voltage can be applied in accordance with a printing signal. These fingers 26 serve as actuators which expand and contract in a vertical direction in response to the applied voltage, so that a corresponding portion of the vibration plate 20 is deflected into the associated ink channel 16. As a result, the ink liquid contained in the ink channel (e.g. a hot-melt ink) is pressurized and an ink droplet is expelled from the nozzle 14.

The central fingers 28 are disposed over the dam portions 18 of the channel plate and serve as support members which absorb the reaction forces of the actuators 26. For example, if one or both actuators 26 belonging to the same block 30 are expanded, they exert an upwardly directed force on the top portion of the block 30. This force is largely counterbalanced by a tension force of the support member 28, the lower end of which is rigidly connected to the channel plate 12 via the ridge 24 of the vibration plate.

The top ends of the blocks 30 are flush with each other and are overlaid by a backing member 32. The backing member 32 is formed by a number of longitudinal beams 34 extending in parallel with the ink channels 16 and by transverse beams 36 which interconnect the ends of the longitudinal beams 34 (only one of the transverse beams is shown in FIG. 1).

The longitudinal beams 34 have a trapezoidal cross section and are originally interconnected with each other at their broader base portions, so that they form a continuous plate. In a subsequent manufacturing step, a comparatively thick layer of piezoelectric material which will later form the blocks 30 is bonded to the plate, i.e. the lower surface of the backing member 32 in FIG. 1. Then, the blocks 30 and the fingers 26, 28 are formed by cutting grooves 38, 40 into the piezoelectric material. While the grooves 38 which separate the fingers 26 and 28 terminate within the piezoelectric material, the grooves 40 separating the blocks 30 are cut through into the backing member 32, thereby separating also the longitudinal beams 34 from one another.

The width of the longitudinal beams 34 is substantially equal to the width of the individual blocks 30. As a consequence, the beams 34 effectively prevent an elastic deformation of the top portions of the blocks 30 when the actuators 26 expand and contract.

Since the support members 28 inevitably have a certain elasticity, expansion of one or both actuators 26 of one of the blocks 30 will also cause a minor expansion of the support members 28 and will tend to cause a slight deflection of the backing member 32. If the backing member were a non-profiled flat plate, this deflective force would be transmitted to the neighboring blocks 30 and would lead to the generation of parasitic acoustic waves in the neighboring ink channels, known as cross-talk. Such long-range cross-talk may cause problems, especially when a large number of actuators in neighboring blocks 30 are simultaneously energized. However, since the backing member 32 is formed by separate beams 34 which are only interconnected at their opposite ends by the transverse beams 36, and these transverse beams are additionally weakened by the grooves 40, the deflective forces are effectively confined to the blocks 30 from which they originate. Thus, the long-range cross-talk phenomenon can be successfully suppressed.

It is not always necessary to cut the grooves 40 through into the backing member 32. Good results were obtained by cutting grooves 40 only into the piezoelectric material, the depth of the grooves 40 being equal to or slightly deeper than the grooves 38. Although, in this situation, the piezoelectric material is not explicitly divided into separate groups, the cross-talk is acceptable and the spacing of the fingers is comparatively large. It is further possible to omit the separate backing member 32. In this situation, the piezoelectric material is chosen to be thicker compared to the thickness of the piezoelectric block from FIG. 1. When the grooves are cut with the same depth as in FIG. 1, the uncut upper portion of the piezoelectric material fulfills the function of the backing member 32.

The subdivision of the array of fingers 26, 28 into separate blocks 30, each consisting of only three fingers, also facilitates the further suppression of short range cross-talk, i.e. cross-talk between the ink channels associated with the same block 30. To this end, it is sufficient to make a distinction between two cases: (a) only one of the two actuators 26 is energized; (b) both actuators are energized. In the (b) case, the support member 28 will be subject to a larger elastic deformation than in the (a) case. This effect can easily be compensated by slightly increasing the voltage applied to the actuators in the (b) case. It should be noted that this measure will not lead to an increased long-range cross talk, because the blocks 30 are separated from each other.

Conversely, in the (a) case, the top portion of the block 30 and the beam 34 will be caused to slightly tilt about the top end of the support member 28, thereby compressing the ink in the neighboring channel. However, this effect will be very small, due to the stabilizing effect of the transverse beams 36. If necessary, this minor effect can also be compensated for by applying a small compensation voltage with appropriate polarity to the actuator associated with the non-firing channel.

Since the support members 28 are made of piezoelectric material, it is also possible to provide additional electrodes for the support members 28 in order to actively counterbalance the reaction forces of the actuators 26.

In the embodiment shown, the width of the grooves 40 is identical to the width of the grooves 38, and the fingers 26, 28 are arranged equidistantly with respect to each other. The pitch "a" of the support members 28 is larger than the pitch "b" of the nozzles 14 by a factor 2. Since every third finger is an actuating member 26, the pitch of the fingers 26, 28 is 2b/3, in comparison to a pitch of b/2 for the conventional case in which a support member is provided between each pair of adjacent ink channels. As a result, the pitch "b" of the nozzles and hence the resolution of the print head can be made small without exceeding the limits imposed by the manufacturing process for the piezoelectric actuators and support members.

In a practical embodiment the pitch "b" of the nozzles 14 may be as small as 250 m (i.e. four nozzles per millimeter). The pitch of the support members 28 will accordingly be 500 m, and the pitch of all fingers (including the actuators 26) will be 167 m. In this case, the width of each individual finger 26 or 28 may, for example, be 87 m, and the grooves 38, 40 will have a width of 80 m and a depth in the order of 0.5 mm.

As is shown in FIG. 2, the grooves 22 and ridges 24 of the vibration plate 20 and the nozzles 14, and the ink channels 16 are not evenly distributed over the length of the nozzle array. Instead, the ink channels 16 are grouped in pairs separated by comparatively broad dam portions 18, whereas the ink channels of each pair are separated by a comparatively narrow dam portion 18'. The broad dam portions 18 coincide with the ridges 24 of the vibration plate and with the support members 28, whereas the smaller dam portions 18' coincide with the grooves 22 of the vibration plate and the grooves 40 between the blocks 30. The width of the ink channels 16 at the top surface of the channel plate 12 is larger than the width of the fingers 26, 28, and the ink channels are offset relative to the nozzles 14 to such an extent that none of the actuators 26 overlap with the dam portions 18, 18'.

The portions of the vibration plate 20 on both sides of the ridges 24, which are held in contact with the actuators 26, are weakened by the grooves 22, and at least a major part of these weakened portions is still within the area of the ink channels 16. Thus, the vibration plate 20 can readily be flexed into the ink channel 16 in response to expansion strokes of the actuators 26. The width of the ridges 24 is slightly smaller than that of the fingers 26, 28.

With the above configuration, an excessive bending or shearing stress in the vibration plate 20 near the edges of the dam portions 18, 18' is avoided, so that a high durability of the vibration plate 20 can be achieved.

In general, the flexibility of the vibration plate 20 is a critical parameter, so that thickness tolerances of the vibration plate may influence the process of droplet generation. Since, in the above embodiment, the ink channels 16 have a rather large width in comparison to the fingers 26, 28 and are offset relative to the nozzles 14, the spacing between the actuators 26 and the edges of the dam portions 18, 18' remains so large that a sufficient flexibility can be achieved with a relatively thick vibration plate, so that the tolerances are less critical.

The flexibility of the vibration plate should be matched to the modulus of elasticity of the channel plate 12. If the vibration plate 20 is rather stiff and the channel plate is comparatively soft, then the dam portions adjacent to an active channel may be slightly compressed, so that the volume of the neighboring channels is also reduced the some extent. The result is a positive coupling between the neighboring channels. Conversely, if the channel plate 12 is rather stiff, the portions of the vibration plate 20 on both sides of a dam portion 18 or 18' may behave like a balance, which results in a negative coupling between adjacent channels. Thus, by appropriately matching the stiffness of the vibration plate and the channel plate, these effects can be caused to cancel each other so that cross-talk is reduced to a minimum.

The vibration plate 20 may be formed by a relatively soft resin foil, e.g. a polyimide resin foil, which is welded to the channel plate 12 and the ends of the fingers 26, 28. Alternatively, the vibration plate may be formed by a thin film of glass or metal, e.g. aluminum, which is soldered to the channel plate and to the fingers.

While a specific embodiment of the present invention has been described above, it will be obvious to a person skilled in the art that various modifications can be made which would fall within the scope of the present invention.

For example, the pitch "a" of the support members 28 may be another integral or even non-integral multiple of the pitch "b" of the nozzles. The width of the actuators 26 may be different from that of the support members 28. Likewise, the width of the grooves 40 may be different from that of the grooves 38, resulting in an uneven distribution of the fingers 26, 28.

Figure 3:
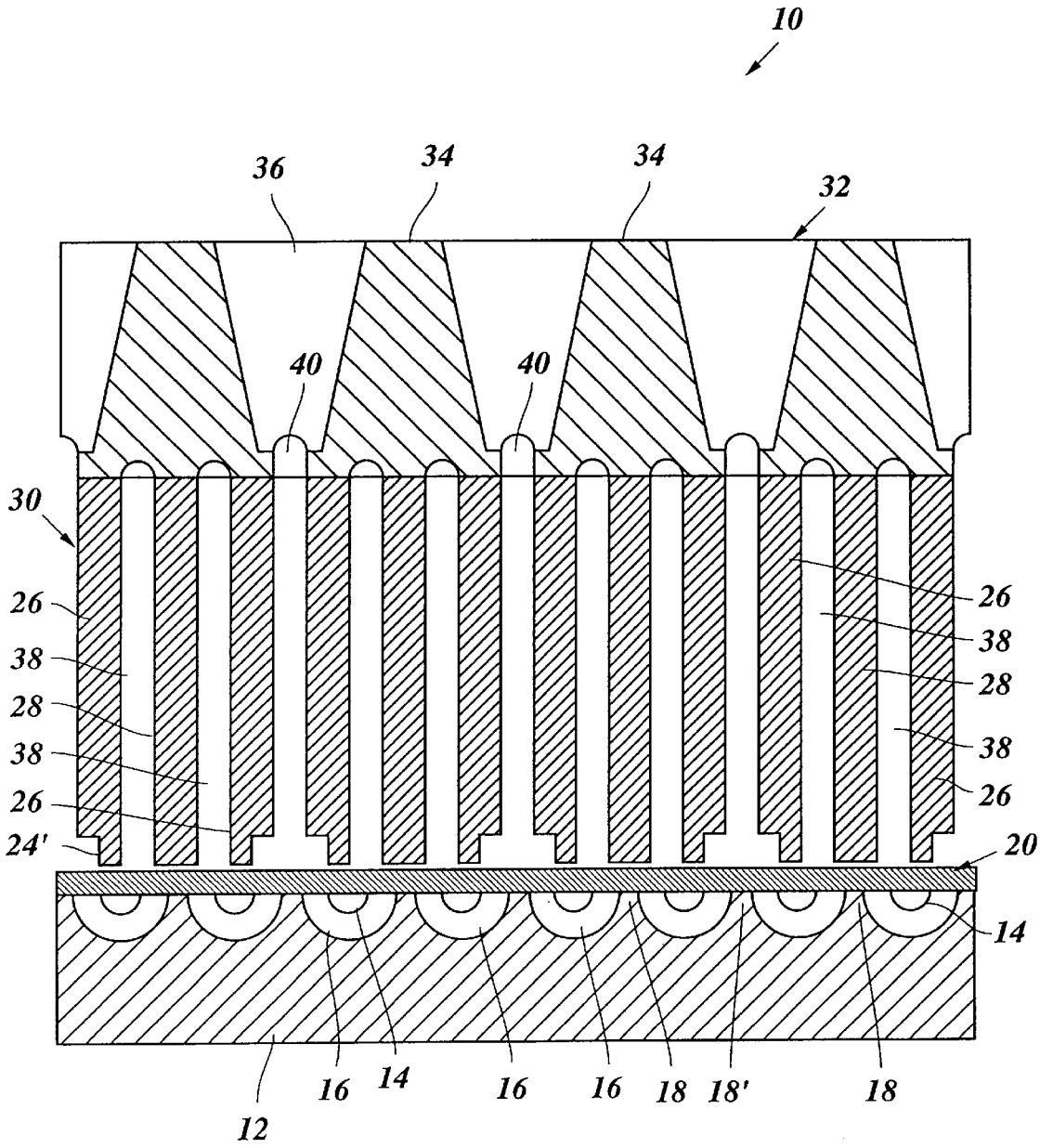
FIG. 3 is a view similar to FIG. 2 but showing a second embodiment of the present invention.

Some other modifications are illustrated in FIG. 3, where the ink channels 16 are arranged equidistantly, without being offset relative to the corresponding nozzles 14.

Instead of using a profiled vibration plate having grooves 22 and ridges 24, a vibration plate 20 with a uniform thickness is used in FIG. 3. In this case, the vibration plate is in contact with the actuators 26 via the ridges 24' formed at the bottom ends of the actuators 26 and appropriately offset from the respective centers of the latter.

As is further shown in FIG. 3, not only the grooves 40 but also the grooves 38 are cut through into the backing member 32, so that one obtains a configuration in which all fingers are completely separated from each other. Alternatively, the depth of the grooves 28, 40 may be reduced such that all fingers 26, 28 are formed by a one-piece member which is not separated into blocks.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet nozzle head comprising:

a channel plate defining a linear array of equidistanced nozzles and a plurality of substantially parallel ink channels communicating with an associated nozzle, a vibration plate disposed on said channel plate, at least one block member containing a comb-like array of fingers which extend toward and engage said vibration plate, some fingers functioning as actuators for exerting mechanical pressure on ink contained in the ink channels which, in turn, expels ink droplets from the nozzles, at least one actuator being provided for each nozzle, and other fingers serving as support members for supporting the actuators at the vibration plate, where the reaction forces of the actuators are received, and a backing member disposed on the block member, wherein a pitch "a" of the support members which is the distance at which the support members are disposed in the direction of the linear nozzle array is larger than a pitch "b" of the nozzles which is the distance at which the nozzles are disposed in the direction of the linear nozzle array and the fingers are evenly distributed over the length of the nozzle array.

2. The nozzle head of claim 1, wherein the pitch "a" of the support members is twice the pitch "b" of the nozzles.

3. The nozzle head of claim 1, wherein the fingers are separated by grooves which all have the same width.

4. The nozzle head of claim 2, wherein the fingers are separated by grooves which all have the same width.

5. The nozzle head of claim 1, wherein the ink channels are separated from one another by dam portions which are closed by said vibration plate which transmits the strokes exerted by the actuators, and wherein each actuator is in contact with a ridge portion of the vibration plate which ridge portion is fully contained within an area of the corresponding ink channel and spaced from the dam portions adjacent said ink channel, thereby allowing a bending deformation of the vibration plate under the action of the actuators.

6. The nozzle head of claim 5, wherein zones of contact between the vibration plate and the actuators are defined by said ridges provided on the vibration plate.

7. The nozzle head of claim 6, wherein the zones of contact between the actuators and the vibration plate are defined by ridges provided at the ends of the actuators.

8. The nozzle head of claim 1, wherein the array of fingers is formed by a plurality of blocks having grooves cut therein for separating the individual fingers, each block being an integral member which comprises at least one support member and a plurality of actuators.

9. The nozzle head of claim 8, wherein each block comprises one support member as a central finger and two actuators arranged symmetrically with respect to the support member.

10. The nozzle head of claim 8, wherein the backing member comprises a plurality of beams extending in the longitudinal direction of the ink channels and respectively disposed on each of the blocks.

11. The nozzle head of claim 1, wherein the vibration plate has grooves and ridges.

12. The nozzle head of claim 1, wherein the vibration plate has a uniform thickness.

13. The nozzle head of claim 1, wherein the actuators and support members are defined by grooves which extend through the block member and into the backing member in the same degree or in varying degrees.

14. An ink jet printer utilizing an ink jet nozzle had comprising:

a channel plate defining a linear array of equidistanced nozzles and a plurality of substantially parallel ink channels communicating with an associated nozzle, a vibration plate disposed on said channel plate, at least one block member containing a comb-like array of fingers which extend toward and engage said vibration plate, some fingers functioning as actuators for exerting mechanical pressure on ink contained in the ink channels which, in turn, expels ink droplets from the nozzles, at least one actuator being provided for each nozzle, and other fingers serving as support members for supporting the actuators at the vibration plate, where the reaction forces of the actuators are received, and a backing member disposed on the block member, wherein a pitch "a" of the support members which is the distance at which the support members are disposed in the direction of the linear nozzle array is larger than a pitch "b" of the nozzles which is the distance at which the nozzles are disposed in the direction of the linear nozzle array and the fingers are evenly distributed over the length of the nozzle array.

* * * * *